United States Patent [19]

Somers

[11] Patent Number: 4,628,644

[45] Date of Patent: Dec. 16, 1986

[54] ABRASIVE MATERIAL SPRAYING APPARATUS

[76] Inventor: Steven Somers, 230 N. Pershing, Mundelein, Ill. 60060

[21] Appl. No.: 637,876

[22] Filed: Aug. 6, 1984

Related U.S. Application Data

[63] Continuation-in-part of Ser. No. 568,486, Jan. 5, 1984, abandoned.

[51] Int. Cl.[4] ..... B24C 5/02

[52] U.S. Cl. ..... 51/427; 51/410; 239/378; 239/526; 222/630; 222/484

[58] Field of Search ..... 51/427, 436, 410, 319, 51/320; 239/302, 375, 376, 378, 526; 222/185, 630, 637, 484

[56] References Cited

U.S. PATENT DOCUMENTS

| | | | |
|---|---|---|---|
| 1,583,918 | 5/1926 | Dunn | 51/410 |
| 1,863,924 | 6/1932 | Dunn | 239/376 |
| 2,305,976 | 12/1942 | McKnight | 51/427 |
| 2,526,403 | 10/1950 | Paasche | 51/427 |
| 3,236,459 | 2/1966 | McRitchie | 239/376 |
| 3,457,102 | 7/1969 | Grekila et al. | 427/423 |
| 3,599,876 | 8/1971 | Kyburg | 239/526 |
| 3,945,571 | 3/1976 | Rash | 239/375 |

*Primary Examiner*—Frederick R. Schmidt
*Assistant Examiner*—Robert A. Rose
*Attorney, Agent, or Firm*—Russell E. Hattis

[57] ABSTRACT

A hand-held spray unit includes a main body preferably having a pistol grip handle depending therefrom with a passageway having an inlet at one end and a nozzle outlet at an opposite end and a mixing chamber adjacent the outlet end with a valve to control one of the handles to control flow of a pressurized fluid. A specially-designed supply container is preferably releasably mounted on the top of the body and has a horizontally elongated tapered funnel-like profile which slopes down toward the front end thereof and extends forwardly and rearwardly of the handle to provide a balance weight of the contents of the supply container. The front of the container has an outlet communicating with the mixing chamber. A rectangular interlocking connection between the container and spray unit body provides a positive releasable interlock therebetween. A slitted nozzle and forwardly directed vent at the rear and top of the supply container avoids blow-back of the sprayed material upon the user and explosion of the container should the nozzle outlet be brought too close to the surface being sprayed or the nozzle becomes clogged.

23 Claims, 9 Drawing Figures

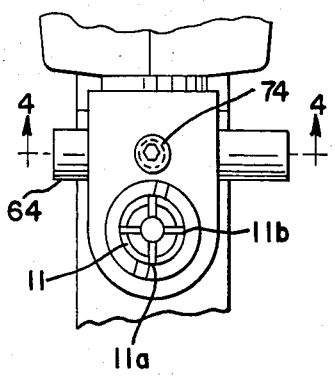
FIG. 3
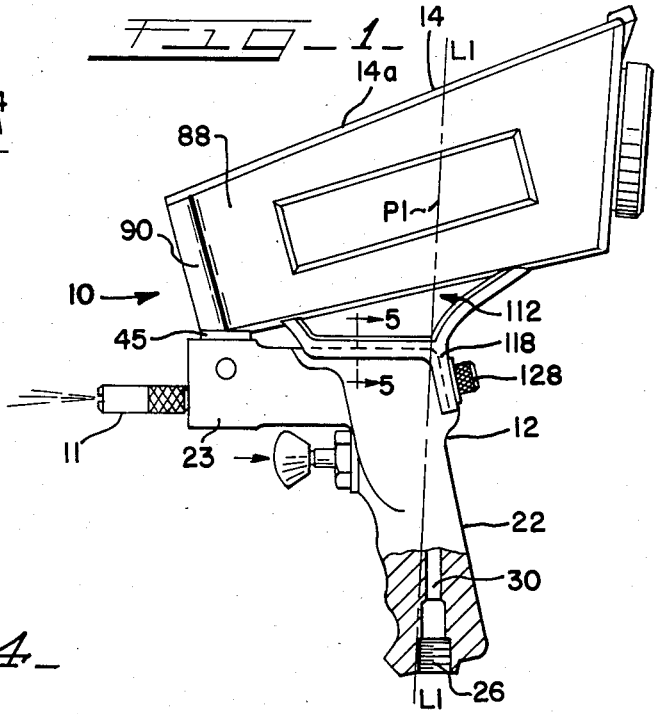
FIG. 1
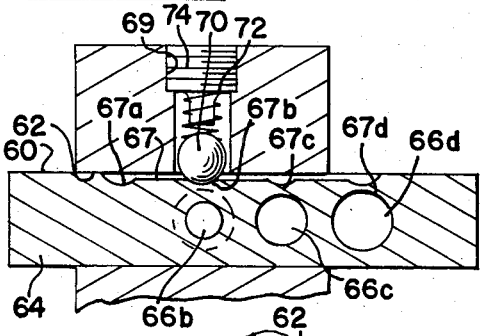
FIG. 4
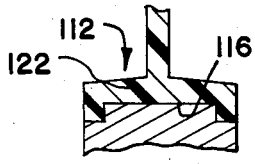
FIG. 5
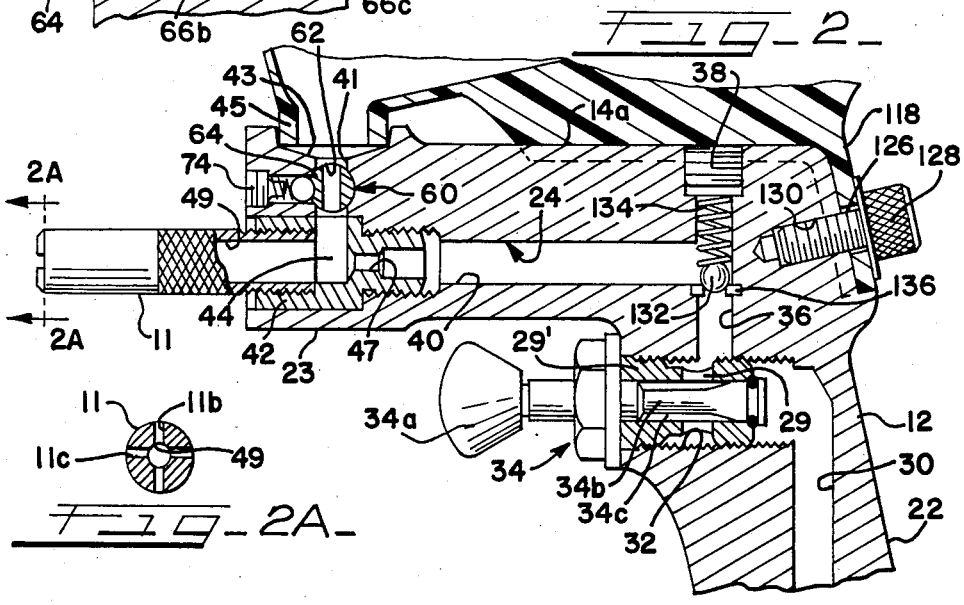
FIG. 2
FIG. 2A

ABRASIVE MATERIAL SPRAYING APPARATUS

REFERENCE TO RELATED APPLICATION

This application is a Continuation-in-part of U.S. application Ser. No. 568,486, filed Jan. 5, 1984 now abandoned.

TECHNICAL FIELD

The present invention relates generally to spraying devices and, more particularly, to a compact, hand-held unit that holds an abrasive material, such as sand or similar granular material, and mixes it with a pressurized fluid, preferably air, in a mixing chamber and delivers it to a working surface.

BACKGROUND PRIOR ART

Abrasive material spray units have been in existence for a number of years for use in removing paint and other coatings from metallic surfaces, and cleaning surfaces of buildings, motor vehicle engine blocks and the like. Examples of such units are disclosed in U.S. Pat. Nos. 2,133,149; 2,411,411; 2,526,403; 2,305,976; 2,163,963; and 3,793,778.

Abrasive material spray units generally utilize pressurized air flowing along a narrow main passageway formed in a main sprayer body and intersected by a transverse passageway extending to a supply of abrasive material, usually sand, in a supply container. The movement of air in the main passageway creates a negative pressure by Venturi or similar action at the intersection of the passageways, which draws sand particles from the container into a mixing chamber thereat. The main sprayer body is usually provided with a pistol grip through which the main passageway extends. In some instances, the supply container is supported on a surface separate from the sprayer body and a flexible tube leading from the container is connected to the portion of the sprayer body forming the mixing chamber. In other instances, the supply container is connected directly to and supported by the main sprayer body so that the container with the abrasive material therein is moved about during the spraying operation. To minimize the inconvenience in frequent re-filling of the container, it is generally desirable that the container be designed to receive a substantial quantity of the material to be sprayed. However, the manipulation of the spray unit with a large and heavy filled supply container is so cumbersome that the spray units are sometimes designed to be grasped by both hands of the user.

The position and orientation of the container supported on the sprayer bodies has heretofore created problems. For example, in some instances these containers projected beyond the front of the spray unit and thus prevented the spray nozzle thereof from being positioned in desired close proximity to the surface to be sprayed, rendering in some cases the cleaning operation involved less effective than was desired. Usually, the supply containers had an appreciable vertical extent, and when supported on the top of the sprayer body interferred with the user's visibility of the surface to be sprayed. The containers so supported are generally completely enclosed containers each with a capped filling opening and, in some cases, a small vent at the top thereof to prevent build-up of pressures in the containers when the sprayer is clogged which could explode the same and to eliminate a vacuum above the supply of adhesive material which would prevent the material from dropping freely to the bottom thereof.

Another problem encountered with such spray units is the lack of control over the amount of abrasive material that is fed therefrom. As will be appreciated, when abrasive material is drawn into the mixing chamber from a supply container mounted on top of the sprayer body, the material feeds into the mixing chamber under both the force of gravity and the low pressure created by the moving air stream. In such case, the level of the material within the supply container can have a significant effect on the amount of material that is drawn into the mixing chamber for a given air stream speed. Also, the available air pressure and other variables can effect the flow rate of the abrasive material involved. Thus, it becomes desirable to vary the rate at which the abrasive material flows from the supply container independently of the air pressure conditions. The present invention provides a unique feature for this purpose, especially useful for containers placed on top of the sprayer body where the abrasive material drops to the bottom of the container by force of gravity.

Prior art spray devices did not take into account the hazardous conditions that can develop when the user brings the spray nozzle very close to the surface being sprayed when it is directed at right angles thereto. In such case, the abrasive material can reflect at high velocities off of the surface and strike and injure the operator and damage the spray unit. Also, in some cases the spray nozzle becomes clogged with the abrasive material so that the air pressure is directed into the supply container where it could force the adhesive material through the vent and thereby injure the operator if the vent is directed toward the user, or drop by force of gravity the abrasive material upon the user if the vent is directed upwards.

There is thus a need for substantial improvements in the adhesive material sprayer art. The various aspects of the present invention deal with minimizing or overcoming the problems of the prior art described above.

SUMMARY OF THE INVENTION

The most preferred form of the invention utilizes a sprayer body having a pistol-grip handle and a supply container supported on the top of the sprayer body. In accordance with one of the features in this preferred form of the invention, a supply container of substantial size is provided which, unlike the prior spray units having supply containers on the top thereof, is designed and located so that the center of gravity of the filled container is in vertical alignment with the handle of the spray unit so that the filled container is balanced with respect to the handle where the user can more easily support and manipulate the sprayer with only one hand gripping the handle thereof.

In accordance with another feature of the invention, the supply container has its discharge opening in front of the handle and preferably near the front end portion of the entire spray unit, while designing the container so that its center of gravity remains in vertical alignment with the handle. This is achieved by designing the container so that it extends both forwardly and rearwardly of the handle, and sloping the bottom of the container toward the discharge opening so that the abrasive material in the supply container compartment is fed by force of gravity to the front thereof where the discharge opening referred to is located. In accordance with another related feature of the invention, instead of the container being of conventional cylindrical shape and projecting appreciably upwardly from the top of the sprayer body, the container is preferably made so that when mounted on top of the sprayer body its long axis extends mainly horizontally along the top of the sprayer body, rather than vertically therefrom. In this way, the large volume of the container is obtained by a large horizontal length, rather than a large vertical height. The resulting low profile of the spray unit makes the spray unit easier to hold and manipulate because the center of gravity of the filled container is quite low, and minimizes interference with the user's view of the surface being sprayed. Preferably the entire container and the supply compartment therein inclines upwardly and rearwardly away from the front portion thereof where the discharge opening is located. Also, the supply container and the compartment thereof preferably is tapered or funnel-shaped so that each has a greater vertical extent behind the handle than forwardly thereof. The upper surface of the container thus preferably slants downwardly and forwardly giving the viewer the most convenient angle of vision of the surface being sprayed.

In accordance with another feature of the invention, the container body is very quickly and easily stably supportable upon the upper surface of the sprayer body. Thus, a longitudinal channel of rectangular cross section extending in the front to rear direction is provided in either the top surface of the sprayer body or the bottom surface of the supply container and a mating projecting portion is provided on the other of same fitting within the channel to give a secure lateral support to the container. Also, the bottom of the supply container has a depending flange preferably at the rear of the sprayer body which receives a threaded anchoring screw threaded into the rear of the sprayer body, to anchor the container very securely and conveniently to the sprayer body. The supply container also preferably has a depending collar at the front thereof defining the discharge opening thereof and this collar preferably is placeable in a tapered positioning recess in the top of the sprayer body where the supply container is then dropped into its proper position upon the sprayer body where the anchoring screw described is threaded into the sprayer body.

In accordance with a further feature of the invention, to eliminate the possibility that the placing of the sprayer nozzle too close to the sprayer surface will result in the reflection of the sprayed material back upon the user, the sprayer nozzle is preferably transversely slitted at the front end thereof to provide one or more laterally extending passages forming alternate paths of flow of the abrasive material when the back pressure created by an unduly close surface to be sprayed results in the lateral passages becoming paths of least resistance for flow of the abrasive material.

In accordance with another feature of the invention, the vent opening provided on the top of the supply container is uniquely directed forwardly rather than upwardly or rearwardly of the supply container, so that a clogged nozzle does not result in the abrasive material being blown up or rearwardly where it can injure the user.

In accordance with a still further feature of the invention, the size of the abrasive material inlet bore of the mixing chamber is made adjustable to vary the feeding rate of the abrasive material. This is most easily achieved by providing a longitudinally adjustable valve body which has a selection of discharge opening sizes which can be selectively placed in vertical alignment with and beneath the discharge opening of the supply container described.

The above and other features of the invention are more fully described and can best be understood from the drawings and description to follow.

BRIEF DESCRIPTION OF SEVERAL VIEWS OF DRAWINGS

FIG. 1 is a side elevational view of a spray unit having the features of the present invention incorporated therein;

FIG. 2 is an enlarged vertical cross-sectional view of portions of the spray unit illustrated in FIG. 1;

FIG. 2A is a vertical sectional view through the spray nozzle of the spray unit of FIGS. 1 and 2, taken along section lines 2A—2A in FIG. 2;

FIG. 3 is a fragmentary front elevational view of the spray unit shown in FIG. 1;

FIG. 4 is an enlarged horizontal cross-sectional view of the spray unit of FIGS. 1-3, as viewed along section line 4—4 of FIG. 3;

FIG. 5 is an enlarged fragmentary, vertical cross-sectional view of the spray unit as viewed along section line 5—5 of FIG. 1, and showing the details of the abrasive material supply container connection to the top of the main body of the spray unit;

DETAILED DESCRIPTION OF PREFERRED EMBODIMENT OF INVENTION

Figure 6:
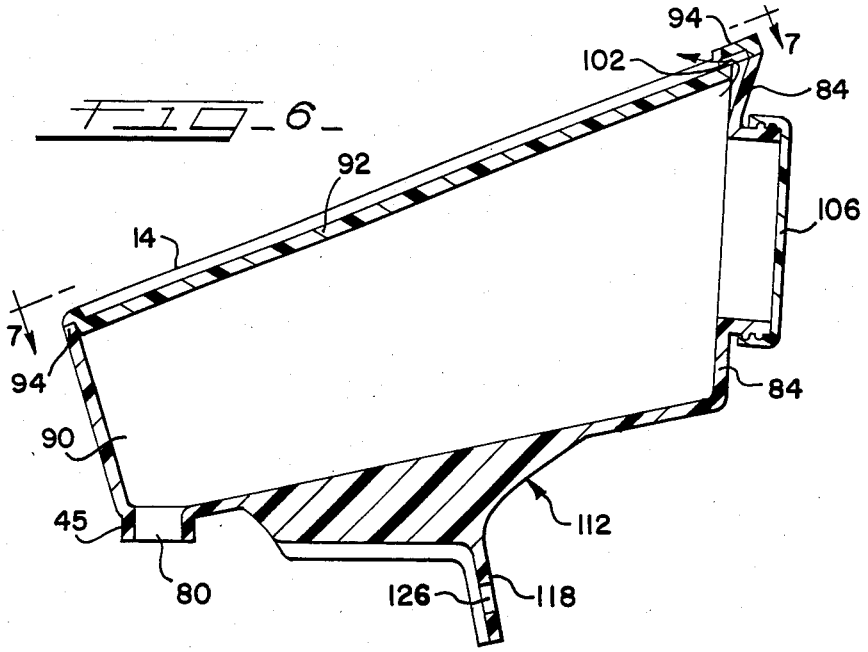
FIG. 6 is a vertical sectional view through the abrasive material supply container of the invention removed from the spray unit body.

While this invention is susceptible of many different forms, there is shown in the drawings and will herein be described in detail a preferred embodiment of the invention, with the understanding that the present disclosure is to be considered as an exemplification of the principles of the various features of the invention and is not intended to limit the broad aspects of the invention to the preferred embodiment illustrated and now to be described.

FIG. 1 shows a hand-held spray unit generally designated by reference numeral 10 and comprising a main body 12 shaped like a pistol and having a spray nozzle 11 at the front thereof, and an abrasive material supply container 14 of very unique shape and orientation. The main body 12 may take a variety of different forms, but preferably is a one-piece unit that is cast or molded to a predetermined configuration and is bored and counterbored to produce a passageway 24. More specifically, the main body 12 has a pistol grip handle 22 depending from a horizontally elongated portion 23 of the main body. An elongated passageway 24 formed by these bores extends through the pistol grip handle 22 and the horizontal elongated portion 23 of the main body 12. This passageway has a threaded inlet 26 at the bottom of the handle 22 adapted for receiving a fitting or coupling (not shown) connecting a source of pressurized air or thereto.

A vertical bore 30 in the handle extends between the inlet 26 and a horizontal threaded intersecting bore 32 which receives a control valve assembly 34, as will be described. The remainder of the passageway 24 includes a vertical bore 36 extending between the horizontal bore 32 and the top of the main body where it is closed by a threaded closure 38. A horizontal bore 40 extends from the front end of the main body 12 and intersects with the vertical bore 36. A threaded insert 42 received in the enlarged extension of bore 40 defines a mixing chamber 44 which opens onto a vertical bore 41 in the main body. The vertical bore 41 terminates in a tapered seat or recess 43 at the top of the body 12, which recess receives a depending discharge opening-defining collar 45 of the supply container 14 to be described. The mixing chamber 44 joins a horizontal Venturi-forming bore 47 formed in the insert 42. The insert 42 threadingly receives the nozzle 11 which has a passageway 49 communicating with the mixing chamber 44.

According to one aspect of the invention, the vertical bore 41 contains a unique slide valve 60 shown in more detail in FIG. 4 which controls the amount of abrasive material discharged from the supply container 14 for a given air pressure applied to the spray unit. The slide valve 60 shown includes a cylindrical valve body 64 slidable in a horizontal transverse bore 62 in the sprayer body 12 which intersects the vertical bore 41 therein. The valve body 64 has a plurality of differently-sized horizontally spaced bores **66*b*, 66*c*, and 66*d* (FIG. 4) therein each of which, when aligned with vertical bore 41, defines a differently sized opening for the passage of abrasive material received from supply container 14. The upper surface of valve body 64 has a groove 67 with spaced ball-receiving depressions or seats 67*a*, 67*b*, 67*c* and 67*d* that define positioning points for the valve body and cooperating with a spring-biased ball 70 that is biased towards the valve body 64 by a spring 72 compressed against the inner end of a threaded closure cap 74 threaded into a horizontal bore 69. When the ball 70 sits in the first recess 66*a*, the vertical sprayer body bore 41 is blocked to stop any discharge of the abrasive material into the mixing chamber 44. When the ball 70 rests in recesses 67*b*, 67*c*, and 67*d*, the differently sized valve body bores 66*b*, 66*c*, and 66*d* become aligned with the larger sprayer body bore 41. Thus, the amount of abrasive material delivered to the mixing chamber 44 can readily be controlled by horizontal movement of the slide valve body 64** to any one of the plurality of positions described.

In accordance with another feature of the invention, to improve the safety and reliability of the spray unit when the spray nozzle 11 is brought too close to the surface to be sprayed by preventing the abrasive material from reaching the surface under this condition, there is provided alternate paths for the flow of the abrasive material preferably in a direction up, down, and laterally of the spray unit. Thus, as best shown in FIG. 2A, the spray nozzle 11, which threads into a threaded bore in the insert 42, has cross slits or grooves **11*a* and 11*b* cut in the forward face thereof which intersect the horizontal nozzle bore 49**. These grooves form alternate paths of least resistance for abrasive material flow extending vertically and horizontally when the back pressure from a close spraying surface increases to a given level.

Figure 7:
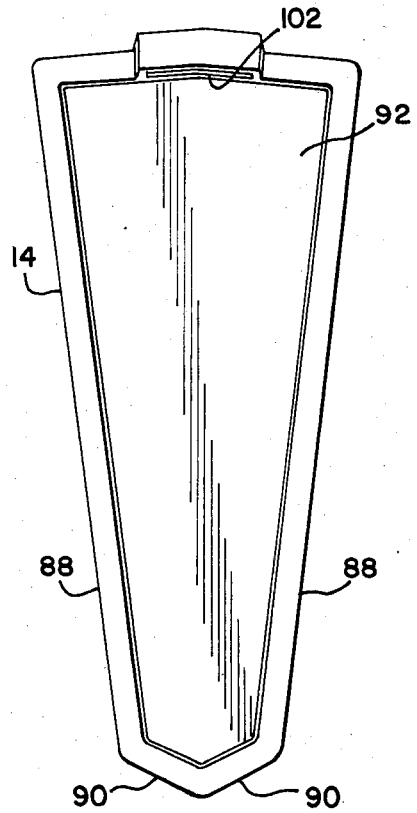
FIG. 7 is a plan view of the container shown in FIG. 6.
Figure 8:
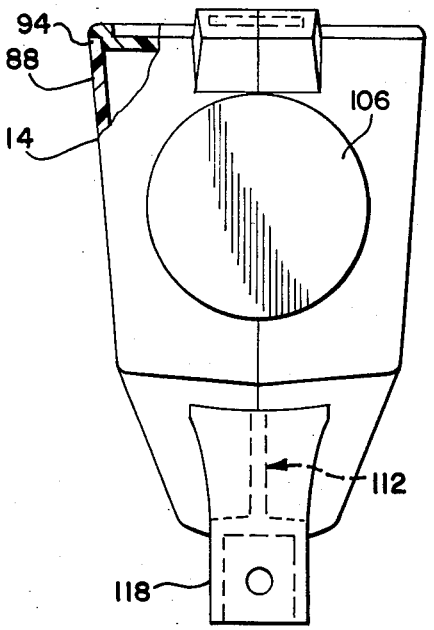
FIG. 8 is a rear end view of the supply container shown in FIG. 6.

According to another and most important aspect of the invention, a very unique abrasive material container supply 14 is provided and arranged to lie along the top of the sprayer body 12 so that the center of gravity thereof is preferably relatively close to the top of the sprayer body and in vertical alignment with the center portion of the handle 22 and also preferably low. This is illustrated by a center of gravity line L1—L1 in FIG. 1 and the center of gravity point P1. Also, the supply container 14 is preferably of a tapered, substantially elongated shape (i.e. at least about twice as long as it is wide) and is mounted along the top of the sprayer body 12 so that its long dimension is generally horizontal, so as to present a thin vertical profile which obstructs only to a very modest extent the user's view of the surface to be sprayed. The top surface **14*a* of the container also preferably slants forwardly and downwardly along the visible most desirable line of sight of the user. Also, the supply container has forwardly and outwardly tapered top and bottom and side walls 90, 93, and 88—88 to provide a funnel-shaped container and compartment 82, giving the containers greater vertical and horizontal dimensions behind the handle 22. As best illustrated in FIG. 6, the supply container compartment has a bottom defining wall 82*a* which slopes downwardly and forwardly so that the abrasive material is fed by force of gravity toward and into the discharge opening 80 at the front thereof defined by the depending collar 45. FIG. 7 shows the forwardly tapered vertical side walls 88—88 of the container 14 which terminate in intersecting vertical front end wall portions 90—90 to define an apex 91 directly forward of the depending collar 45**.

The top wall 92 of the container 14 is preferably transparent and is secured in any suitable way to the remainder of the container body. The outer rear end of the container is defined by a vertical wall 84 which has a forwardly directed lip 94 that defines a forwardly directed vent passage 102 which communicates with the container interior to vent the same. This vent opening uniquely faces forwardly so that if the nozzle 11 becomes clogged and the pressurized fluid involved forces the abrasive material in the container out of the vent, the material is directed away from the user holding the spray unit.

The rear vertical wall 84 of the container preferably has a threaded collar 104 opening rearwardly into the exterior of the container, to form a filling opening for the container when it is removed from the sprayer body 12. It receives a preferably transparent cap 106 threaded thereover which enables the user to see the amount of abrasive material in the container when the sprayer is in use and positioned in front of the user's eyes. Thus, with the container described, the container can either be filled through the opening in the collar 104.

According to a further feature of the invention, the container 14 also has a unique bottom support which securely mounts and secures the container to the spray unit body. Thus, there is preferably integrally-molded with the lower portion of the container an inverted T-shaped neck 112 which has a downwardly facing rectangular channel 116 (FIG. 5) which interlocks with a gating rectangular upwardly extending projection 122 of the sprayer body 12 which prevents lateral tilt of the container. The inverted T-shaped neck 112 has a depending rear flange 118 with a rectangular channel in the bottom thereof which interlocks with a rectangular projecting portion on the rear end of the sprayer body, as neck 112 does with the top thereof. The depending flange 118 also has an opening 126 which receives the threaded shank of an anchoring screw 128 which is threaded into an opening 130 in the rear of the spray unit body.

It will be recalled that the discharge opening 80 at the front of the container 14 is defined by a depending collar 45 which fits into a downwardly tapering recess 43 in the body 23. The container is positioned in its interlocked position with the spray unit body 23 as described by first placing the depending collar 45 in the recess 43 which acts as a positioning means for the container, and then dropping the rest of the same upon the top of the body 12.

The on-off valve assembly 34 may include a longitudinal movable handle **34*a* having a shank portion 34*b* with an annular recess 34*c*. When the valve handle 34*a* is in the position shown, a vertical bore 29 in a stationary insert sleeve 29' is blocked by the shank 34*b* from communication with the gripping handle bore 30. However, when the valve handle is moved longitudinally inwardly, the annular recess 34*c* opens onto the bore 30 to interconnect the vertical bore 29 in insert 29' to the bore 30, to permit passage of the pressurized fluid through the rest of the passageway 24 of the sprayer body 23**.

To avoid abrasive material remaining in a dormant nozzle from dropping into the on-off valve to clog the same when the front of the spray unit is tilted upwards when grasped by the user a one-way ball check valve is provided comprising a ball 132 (FIG. 2) urged by a spring 134 against a shoulder 136 in the vertical bore 36 of the sprayer body 12. The spring 134 is compressed against a closure 38 threaded into a counter-bore at the top of the sprayer body bore 36.

Thus, it will be appreciated that the container 14 is an easily filled and securely mountable unit which has a relatively low center of gravity for its volume and is in a balanced position upon the spray unit body relative to the hand gripping axis thereof. The horizontally elongated tapered profile of the mounted container which projects both forwardly and rearwardly of this axis provides a large storage capacity with minimum obstruction of the view of the user. The downwardly sloping bottom-defining wall of the container compartment provides a gravity feed of the abrasive material to the discharge opening 80. The slitted nozzle 11 and the forwardly facing container vent 102 ensures that abrasive material will not be forced against or dropped upon the user, should the nozzle be clogged or brought too close to a surface being sprayed with abrasive material.

It should be understood that numerous modifications may be made in the most preferred form of the invention described without deviating from the broader aspects thereof.

I claim:

1. In a spray unit for delivering at a front end thereof a mixture of a pressurized carrier and an abrasive material or the like, said spray unit when oriented so as to spray said material horizontally therefrom comprising a main body having a gripping handle depending therefrom behind said front end, a mixing chamber in said main body, means for delivering the pressurized carrier to said mixing chamber, inlet passage means on said main body communicating with said mixing chamber for receiving abrasive material, and supply means for said abrasive material located on top of said body and above said handle for delivering abrasive material to said inlet passage means, said supply means including a container having an outlet in communication with said inlet passage means, the improvement wherein said container and a material supply compartment therein have a generally horizontally extending and elongated configuration extending substantially both forwardly and rearwardly of said handle so that the center of gravity of a filled container is relatively close to said main body, said container having a horizontal extent which is at least twice its maximum vertical extent at any point along the length thereof, said container having an outer top wall surface which slopes downwardly and forwardly toward the front thereof to increase the field of vision of the user thereof.

2. The spray unit of claim 1 wherein there are releasable connecting means between the container and body for enabling the container to be released from said body.

3. The spray unit of claim 1 wherein when said container is filled with said abrasive material it has a center of gravity vertically aligned with said handle.

4. The spray unit as defined in claim 1, in which said spray unit body is located for the most part forwardly of said gripping handle with said mixing chamber therein located generally at a forward end.

5. The spray unit as defined in claim 2, in which said releasable connecting means includes a horizontal, longitudinally extending channel in one of said container and body and a mating projection in the other of same extending into said channel, and a releasable fastener between said container means and said body.

6. The spray unit as defined in claim 1, in which said container and said compartment therein have forwardly tapered opposite side, top and bottom walls.

7. The spray unit as defined in claim 1 in which said container has a rear wall with a filling opening, and there is provided a removable closure cap for sealing said filling opening.

8. The spray unit of claim 7 or 9 wherein said closure cap is transparent so the user can see the material in said container while the unit is held in a spraying position.

9. The spray unit as defined in claim 1, in which said container has forwardly facing vent means at a top and rear thereof for venting the container.

10. The spray unit of claim 1 wherein said center of gravity is vertically aligned with a center portion of said handle.

11. The spray unit of claim 1 wherein said container compartment is horizontally elongated so that its horizontal extent is at least twice its maximum vertical extent at any point along the length thereof, to reduce the height of the vertical profile of the spray unit body above the spray unit and provide a lower center of gravity.

12. In a spray unit for spraying an abrasive material, said spray unit when oriented so as to spray said material horizontally therefrom comprising: a hand grippable main body having a gripping portion, said body having a main passageway extending between a pressurized fluid inlet and a forwardly facing outlet of a discharge nozzle at a front end portion of said body where pressurized fluid-entrained particles of an abrasive material are discharged from the body through said nozzle, said body having a depending pistol grip-like handle at the bottom thereof, and a supply container for abrasive material particles at the top of said body, said container having a storage compartment for said abrasive particles and a discharge opening at a bottom thereof for discharge of the particles, said container discharge opening communicating with a vertical passage in said main body which intersects said body passageway so that the abrasive particles drop into and become entrained in the pressurized fluid moving therein, the improvement wherein said container and compartment therein are horizontally elongated so that they extend substantially in front of and behind said handle and so that their horizontal extent is at least twice their maximum vertical extent measured at any point along the length thereof, to reduce the height of the vertical profile of the spray unit above the spray unit body and to lower the center of gravity thereof, said container when filled has a center of gravity which is in substantial vertical alignment with the center of the gripping region of the grippable portion of the main body.

13. The spray unit of claim 12 wherein said compartment has a forwardly and downwardly sloping bottom defining wall, and said discharge opening of said container is at said front end portion of said body where the abrasive particles on said bottom-defining wall move toward said discharge opening at least partially under force of gravity.

14. The spray unit of claim 1 or 12 wherein the vertical extent of said container and compartment therein gradually increase from the front to the rear thereof to provide a funnel-shaped container profile, an upper surface of said container thereby sloping forwardly and downwardly.

15. The spray unit of claim 12 wherein said container is removably secured to an upper surface of said body through an interconnection comprising a generally horizontally and longitudinally extending non-circular channel in one of said body and container and a correspondingly shaped projection in the other of same fitting into said channel to provide lateral stability to the container, and releasable anchoring means for anchoring said container in position on said body.

16. In a spray unit for spraying an abrasive material, said spray unit comprising a hand grippable main body having a main passageway extending between a pressurized fluid inlet and a forwardly facing outlet of a discharge nozzle at a front end portion of said body where pressurized fluid-entrained particles of an abrasive material are discharged from the body through said nozzle, said body having a depending pistol grip-like handle at the bottom thereof, and a supply container for abrasive material particles removably secured to an upper surface of said body, said container having a storage compartment for said abrasive particles and a discharge opening at a bottom front portion thereof for discharge of the particles, said container discharge opening communicating with a vertical passage in said main body which intersects said body passageway so that the abrasive particles drop into and become entrained in the pressurized fluid moving therein, the improvement wherein said bottom front portion of the container about said discharge opening being droppable into said vertical passage in said main body, the bottom portion of said container and said main body behind said discharge opening having complementary mating surfaces, releasable anchoring means for anchoring said container on said main body and including a depending flange on said container confronting a rearwardly facing surface on said body, and means releasably holding said flange against said rearwardly facing surface of said body.

17. The spray unit of claim 12 wherein said compartment has a forwardly and downwardly sloping bottom defining wall, and said discharge opening of said container is at said front end portion of said body where the abrasive particles on said bottom-defining wall move toward said discharge opening at least partially under force of gravity.

18. The spray unit of claim 17 wherein said container has a forwardly facing vent at a rear and top thereof.

19. The spray unit of claim 12 wherein said container is removable from said body and is substantially horizontally elongated, said container having a filling opening and removable closure cap thereover at a rear of said container so that said container can be filled by orienting the spray unit so that the filling opening is at the then top of the spray unit and container for convenient filling thereof with abrasive particles.

20. In a spray unit for spraying an abrasive material, said spray unit when oriented so as to spray said material horizontally therefrom comprising: a hand grippable main body having a main passageway extending between a pressurized fluid inlet and the outlet of a forwardly-facing discharge nozzle at a front end portion of said body where pressurized fluid-entrained particles of an abrasive material are discharged from the body through said nozzle, said body having a handle and a supply container for abrasive material particles at a top of said body, said container having a storage compartment for said abrasive particles and a discharge opening at a bottom thereof for gravity discharge of the particles, said container discharge opening communicating with a vertical passage in said body which intersects said body passageway so that the abrasive particles drop into and become entrained in the pressurized fluid moving therein, the improvement wherein said container is vented at the top thereof, said vent facing forwardly so that if the discharge nozzle is clogged abrasive material forced through the vent will be directed away from the user.

21. The spray unit of claim 1 or 12 wherein an outer top wall surface of said container slopes downwardly and forwardly toward the front thereof to increase the field of vision of the user thereof.

22. The spray unit of claim 1 or 12 wherein the container has side walls which converge in a forward direction to increase the field of vision of the user thereof.

23. The spray unit of claim 1 wherein said container compartment is defined by a bottom wall which inclines upwardly and away from said outlet which is at the front end thereof.

* * * * *